US005505263A

United States Patent [19]

White et al.

[11] Patent Number: 5,505,263

[45] Date of Patent: Apr. 9, 1996

[54] PACKER SET SAFETY VALVE FOR CONTROLLING DUAL FLUID FLOWS

[76] Inventors: Pat M. White, 2310 Bush Cir., Carrollton, Tex. 75007; Robert W. Crow, 1620 Post Oak, Irving, Tex. 75061

[21] Appl. No.: 134,360

[22] Filed: Oct. 8, 1993

[51] Int. Cl.[6] ..... E21B 34/10; E21B 33/128; E21B 33/129; E21B 43/12

[52] U.S. Cl. ..... 166/374; 166/122; 166/126; 166/129; 166/142; 166/319; 166/384

[58] Field of Search ..... 166/375, 374, 166/129, 145, 151, 142, 122, 126, 134, 123, 319, 384, 386

[56] References Cited

U.S. PATENT DOCUMENTS

| | | | |
|---|---|---|---|
| 3,467,184 | 9/1969 | Young | 166/129 |
| 4,271,903 | 6/1981 | Slagle, Jr. et al. | 166/129 |
| 4,432,417 | 2/1984 | Bowyer | 166/129 X |
| 4,434,847 | 3/1984 | Vazquez et al. | 166/375 X |
| 4,842,074 | 6/1989 | Hines et al. | 166/305.1 |
| 4,844,166 | 7/1989 | Going, III et al. | 166/372 X |
| 5,048,610 | 9/1991 | Ross et al. | 166/129 X |
| 5,141,057 | 8/1992 | Chaix | 166/373 |

FOREIGN PATENT DOCUMENTS

| | | |
|---|---|---|
| 2093094 | 2/1982 | United Kingdom . |
| 2117032 | 3/1983 | United Kingdom . |
| 2235938 | 8/1990 | United Kingdom . |
| 2243634 | 5/1991 | United Kingdom . |

*Primary Examiner*—Stephen J. Novosad

[57] ABSTRACT

A packer set safety valve assembly for controlling annular and tubing flows within a subterranean wellbore is disclosed. The packer set safety valve assembly controls the annular and tubing flows through dual flow paths. The assembly includes a means, that is remotely actuatable, to secure the assembly within the wellbore, a means, also remotely actuatable, the allows selective control of fluid flow in the dual flow paths, and a means, remotely actuatable as well, to unsecure the assembly from within the wellbore. The packer set safety valve assembly is a "fail closed" design which prevents flows through the dual flow paths when the fluid flow control means is not actuated to allow flow.

27 Claims, 4 Drawing Sheets

PACKER SET SAFETY VALVE FOR CONTROLLING DUAL FLUID FLOWS

BACKGROUND OF THE INVENTION

1. Field of the Invention

The invention generally relates to flow control apparatus for subterranean wells connected by wellbore with the surface and, more particularly, relates to a safety valve which may be set by packer for simultaneously controlling fluid flow through an annulus and tubing string connecting the subterranean well with the surface through the well bore.

2. Description of the Related Art

In a number of applications, flow control apparatus must serve to simultaneously allow or restrict dual flows, for example, simultaneous upward and downward flows, through separate flow paths within a wellbore. One example of such an application is natural gas storage wells. A natural gas storage well is a subterranean cavern formed within a salt dome or other similarly non-permeable cavernous geologic structure. These underground caverns are connected with the surface through a wellbore drilled from the surface to the cavern. The wellbore is typically cased with a casing string from the surface to the cavern, and one or more tubing strings may be run within the cased wellbore for flow of fluids from and to the cavern to the surface.

In operation of a gas storage well, previously produced gas is pumped under pressure down into the subterranean cavernous storage structure. Because the gas pumped into the storage well is pressurized, the well must include some means for containing the pressurized gas within the well and some means for allowing select flow of the gas from the underground cavern, through the wellbore, to the surface, when retrieval is desired.

In certain gas storage wells, it is desired that two different fluids, for example, gas and water, be simultaneously pumped into and out of, respectively, the storage well. These wells will typically have what is called a syphon tubing string extending from the surface through the wellbore to near the bottom of the storage well within the underground cavernous structure. Gas is generally pumped into the storage well through the annulus space in the wellbore formed between the syphon tubing string and the well casing. Water is generally retrieved up the syphon string. By selectively controlling flows of gas and water into and out of these gas storage wells, a somewhat constant pressure may be maintained within the storage well by simultaneously varying the gas volume and the water volume of the storage well. For instance, as gas is retrieved through the annulus between the syphon tubing string and the wellbore casing out of the storage well, water is pumped into the storage well through the syphon tubing string in order to maintain pressure by reducing volume available for gas storage within the storage well. The reverse process, gas injection into and water retrieval from the storage well, can also maintain storage well pressure in a similar manner.

In these storage wells and other similar storage arrangements, some means is necessary for simultaneously controlling flow of gas and other fluid into and out of the storage well, as previously mentioned. In the past, safety valves have been placed at the surface in the wellhead (or "Christmas tree") which tops the wellbore. The wellheads in these prior arrangements also have contained at least some, if not all, of the actuating parts of those safety valves. Though these safety valves have proven somewhat effective in controlling flows of gas and other fluids in and out of storage wells, location of these valves and the actuating parts within the wellhead at the surface presents certain problems. In particular, if the wellhead is ever damaged, the safety valves may be damaged or otherwise affected, possibly causing loss of the safety system. If the flow control safety system is lost, gas within the storage wells can escape, often with disastrous effects.

The present invention provides a means for controlling dual flows into and out of pressurized storage chambers, such as underground storage wells. The invention is an improvement over the art because the flow control mechanism is not dependent upon occurrences at the surface, such as at the wellhead. Thus, any problems with damage to the wellhead will not affect the operation of the mechanism as a safety device. Additionally, the flow control mechanism allows for two separate flow paths with simultaneous control of flow within those paths. The mechanism additionally provides for equalization of pressure between the flow paths when the storage chamber is shut in. Even further, the mechanism may be run on coil tubing and may be run, set, put on line, and retrieved under pressure, allowing for practical operation without requiring extreme measures. Finally, the mechanism is contained in a single device and so results in reduced expense and simplification of installation and operation of the device.

SUMMARY OF THE INVENTION

In one embodiment, the invention is an assembly for controlling flows through dual flow paths within a subterranean borehole. The assembly comprises means for securing the assembly within the borehole, the means for securing being remotely actuatable to allow the assembly to be run into the borehole into select position within the borehole and then secured at the select position within the borehole; means for selectively allowing and restricting flow pass age through the dual flow paths within the borehole, the means for selectively allowing flow passage being remotely actuatable from the assembly within the borehole; and means for unsecuring the assembly from securement within the borehole as and when desired, the means for unsecuring being remotely actuatable to allow the assembly to be unsecured and then the assembly to be retrieved from within the borehole.

In another aspect, the means for selectively allowing and restricting flow passage includes means for preventing flows through the dual flow paths when the means for selectively allowing and restricting flow passage is not actuated to allow flow.

In a further aspect, the means for selectively allowing and restricting flow passage prevents flows through the dual flow path if the means is not remotely actuatable.

In yet another aspect, the dual flow paths are within a coil tubing and in an annular space formed between the coil tubing and the borehole.

In yet a further aspect, fluid pressure is employed to activate the means for securing to secure the assembly within the borehole, to actuate the means for selectively allowing and restricting flow passage to control the flow through the dual flow paths, and to activate the means for unsecuring to unsecure the assembly from within the borehole.

In another aspect, the means for selectively allowing and restricting includes a piston means, biased in a first direction, the piston means allowing flows through the dual flow paths when sufficient actuating force is applied to the piston means overcoming the bias and moving the piston means in a second direction opposite that of the first direction, the piston means restricting flows through the dual flow paths when the sufficient actuating force is not applied to the piston means.

In an even further aspect, the dual flow paths are within a coil tubing and in an annular space formed between the coil tubing and the borehole.

In another aspect, the assembly, when restricting fluid flows through the dual flow paths, seals the fluids beneath the assembly's vertical location within the borehole, preventing flows from beneath the assembly's vertical location within the borehole to outside the borehole.

In a further aspect, when restricting flows through the coil tubing and the annular space, respectively, the assembly seals the fluids within the coil tubing and the annular space beneath the assembly's vertical location within the borehole.

In another aspect, the assembly is placed into the borehole for securement within the borehole via the coil tubing and the assembly is retrieved from the borehole when unsecured from within the borehole via the coil tubing.

In an even further aspect, the assembly includes a tubing conduit through which may selectively pass one of the dual fluids flowing in the coil tubing and an assembly annular space formed between the tubing conduit and the housing of the assembly concentric with the tubing conduit through which may selectively pass the other of the dual fluids flowing in the annular space between the coil tubing and the borehole.

In even another aspect, the fluid pressure to activate the means for securing is about 4,000 psi, the fluid pressure to actuate the means for selectively allowing and restricting flow passage is somewhat lower than about 4,000 psi, and the fluid pressure to activate the means for unsecuring is about 6,500 psi.

In another embodiment, the invention is a packer set safety valve for controlling flows of dual fluids, one of the dual fluids flowing in a tubing string of a subterranean well, the other of the fluids flowing in an annular space formed between the tubing string and a wellbore of the subterranean well. The packer set safety valve comprises means for opening the safety valve to allow flows of the fluids between the wellbore and outside the wellbore and means for selectively actuating the means for opening to allow the flows.

In another aspect, the safety valve is closed unless the means for selectively actuating activates the means for opening to allow flows of the fluids between the wellbore and outside the wellbore.

In even another aspect, the dual flows are in opposite directions.

In yet another aspect, the subterranean well is a gas storage well.

In a further aspect, the means for opening includes a tubing conduit having a solid portion therein and an upper tubing port and a lower tubing port situated on either side of the tubing conduit, the tubing conduit connects with the tubing string, and a valve piston, concentric with and slidably engaged with the tubing conduit, the valve piston acting to open the upper tubing port and the lower tubing port to allow flow therebetween and through the tubing conduit of the fluid flowing in the tubing string when the means for selectively actuating is actuated and maintaining the upper tubing port and the lower tubing port closed preventing flow therebetween and through the tubing conduit when the means for selectively actuating is not actuated.

In even another aspect, the means for opening includes a packer mandrel enclosing the tubing conduit and the valve piston and having an upper tubing port closed by the valve piston to fluid flow therethrough but open for fluid flow therethrough when the means for selectively actuating is activated and the valve piston includes a lower annular port allowing fluid flow from within an annulus between the tubing conduit and the valve piston when the means for selectively actuating is actuated but preventing the fluid flow when the means for selectively actuating is not actuated, the flow being the fluid flowing in the annular space formed between the tubing string and a wellbore of the subterranean well.

In yet a further aspect, the safety valve further comprises means for setting the safety valve in select location within the wellbore and means for unsecuring the safety valve from the select location within the wellbore and wherein each of the means for selectively actuating, the means for setting, and the means for unsecuring are actuated by pressure.

In even another aspect, the safety valve further comprises means for setting the safety valve in select location within the wellbore, means for sealing the safety valve within the wellbore at the select location, means for unsecuring the safety valve from the select location within the wellbore, and means for unsealing the safety valve from within the wellbore at the select location and wherein the means for setting, the means for sealing, the means for unsecuring, and the means for unsealing are each activated by pressurized control fluid.

In yet another embodiment, the invention is a method of controlling dual flows within segregated spaces of a longitudinally extending chamber. The method comprises the step of placing a packer set safety valve assembly across each of the segregated spaces parallel to a primary direction of the flows.

In even another embodiment, the invention is a method of controlling fluid flow in a wellbore containing a tubing string in which a first fluid flows and an annular space between the tubing string and a concentric inner surface of the wellbore in which a second fluid flows. The method comprises the steps of placing an assembly for controlling flows within the tubing string and within the annular space in the wellbore, the assembly including: (a) means for securing the assembly within the wellbore, the means for securing being remotely actuatable, and (b) means for selectively allowing and restricting flow passage through the tubing string and through the annular space, the means for securing being remotely actuatable; and actuating the means for securing to set the assembly at a select location in the wellbore; and actuating the means for selectively allowing and restricting flow to selectively allow and selectively restrict flow passage through the tubing string and through the annular space.

In another aspect, the assembly further includes means for unsecuring the assembly from securement within the wellbore, the means for unsecuring being remotely actuatable, and further comprising the step of actuating the means for unsecuring to unsecure the assembly from within the wellbore for retrieval of the assembly.

DETAILED DESCRIPTION OF THE INVENTION

Figure 1:
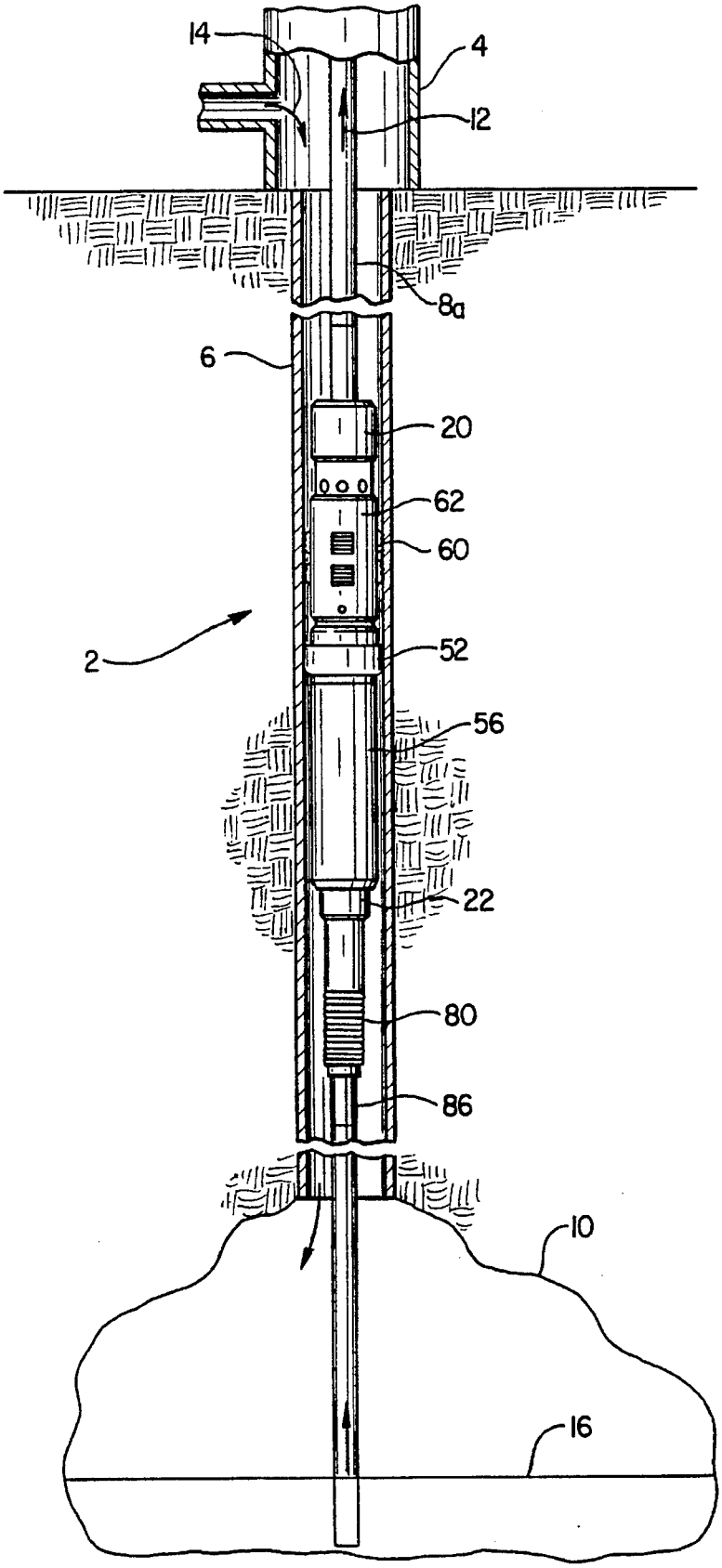
FIG. 1 is a schematic, vertically foreshortened cross-sectional view of a representative subterranean gas storage well, showing the wellbore with casing and wellhead at the surface, and having disposed within the casing of the wellbore a packer set safety valve run on coil tubing, embodying the principles of the present invention.

Referring first to FIG. 1, a representative storage chamber, for example, a subterranean storage well being an underground cavern 10 connected with the surface by a wellbore equipped with casing 6 and coil tubing 8*a, b,* is shown with the packer set safety valve assembly 2 of the present invention in operation therewith. At the top of the casing 6, a wellhead 4 (shown in part) has been constructed to provide surface flow paths for gas or other fluid retrieved from within the cavern. The cavern 10 contains a level of a liquid 16, such as water, and gas occupies the cavern 10*n* volume not occupied by the liquid 16. An upper coil tubing 8*a* is connected to one end of the assembly 2 and a lower coil tubing 8*a, b* is connected to the other end. The coil tubing 8*a, b,* together with the assembly 2, is run into the wellbore through the casing 6 so that the lower coil tubing 8*b* reaches almost the lowest depth of the cavern 10. The lower coil tubing 8*b* is of sufficient length so that the assembly 2 becomes located near, but below, the terranean surface.

Still referring to FIG. 1, the assembly 2, when located within a wellbore of a storage cavern 10, operates to control flow of two fluids from and into the cavern 10. At first fluid 14, which is typically gas, may flow into the cavern 10 through the annular space formed between the coil tubing 8*a, b* and casing 6. As the first fluid 14 flows into the cavern 10, a second fluid 12, which is typically liquid, is retrieved from the cavern 10 through the coil tubing 8*a, b* to provide space for the first fluid 14 while maintaining somewhat consistent pressure within the cavern 10. Alternatively, the second fluid 12 could flow into the cavern 10 via the coil tubing 8*a, b* and the first fluid 14 could flow from the cavern 10 via the annulus formed between the coil tubing 8*a, b* and the casing 6. In any event, the packer set safety valve assembly 2 serves to control flow of the first fluid 14 and the second fluid 12 within the respective annular and tubing passageways. In this manner, flows into and out of the cavern 10 may be selectively regulated and controlled.

Continuing still to refer to FIG. 1 the assembly 2 is generally comprised of annular valve means, tubing valve means, set means, seal means and control means. When the assembly is in the run-in position, being located for operation within the wellbore, the annular valve means is open allowing annular flow through the assembly 2, the tubing valve means is closed preventing tubing flow through the assembly 2, and the control means is not activated. Once the assembly 2 is run-in the wellbore to appropriate depth of the coil tubing 8*b*, the assembly 2 is set at the vertical location along the casing 6 by activating the control means, for example, by application of pressure thereto. Activation of the control means to set the assembly 2 causes both the annular valve means and the tubing valve means to open, allowing both annular flow and tubing flow through the assembly 2, and the set means and seal means to fix and seal the assembly within the casing 6. When fixed in position for operation within the casing 6, the assembly 2 then provides for select activation of opening and closing the annular valve means and the tubing valve means by activating the control means. In this manner, both annular and tubing flow control may be achieved as desired. The control means also may allow retrieval of the assembly 2 when again it is activated, this time to cause the tubing valve means to close and the annular valve means to open so that only annular flow through the assembly 2 is again possible, and the set means and seal means to release from fixed and sealed location within the casing 6. It is of important note that in the preferred embodiment of the invention the annular valve means and tubing valve means are each fail closed, meaning that when the control means is not activated the annular valve means and tubing valve means are closed to fluid flow. Because the assembly 2 may be located within the wellbore below surface level and closure of fluid flow is independent of the control means when not activated, loss or damage to the wellhead at the surface of the well does not affect the shut-in capability of the annular valve means and tubing valve means. This safety feature of well shut-in by the present invention, even upon loss of the wellhead and any control structures associated therewith, is a significant advantage over the prior technology.

Figure 2A:
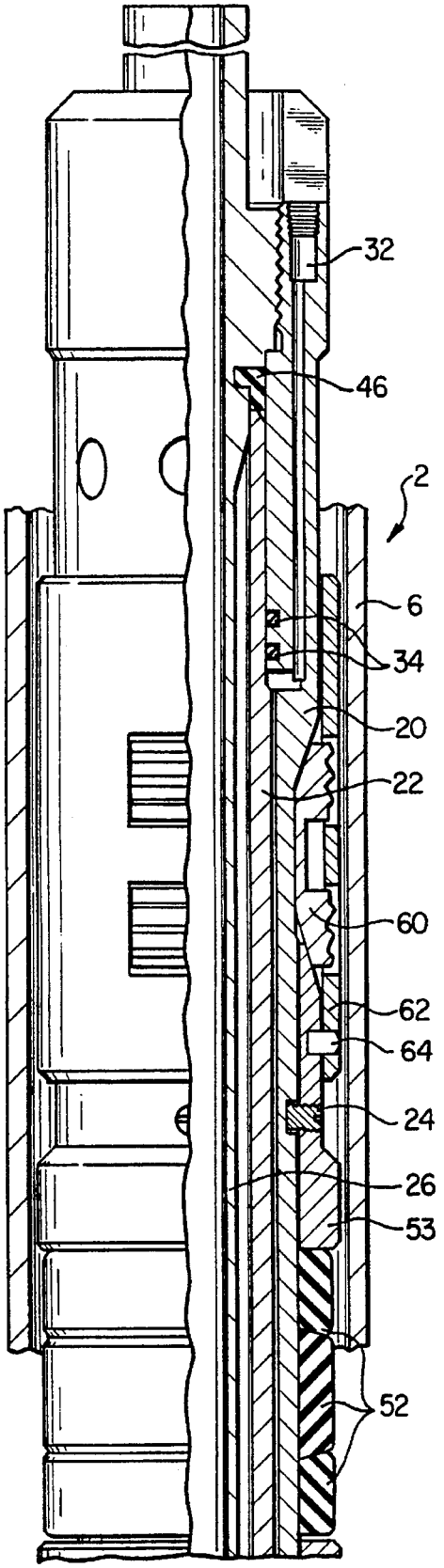
FIGS. 2A–2B are a part perspective and part cross-sectional view through the packer set safety valve of the present invention, showing the assembly in its run-in position.
Figure 2B:
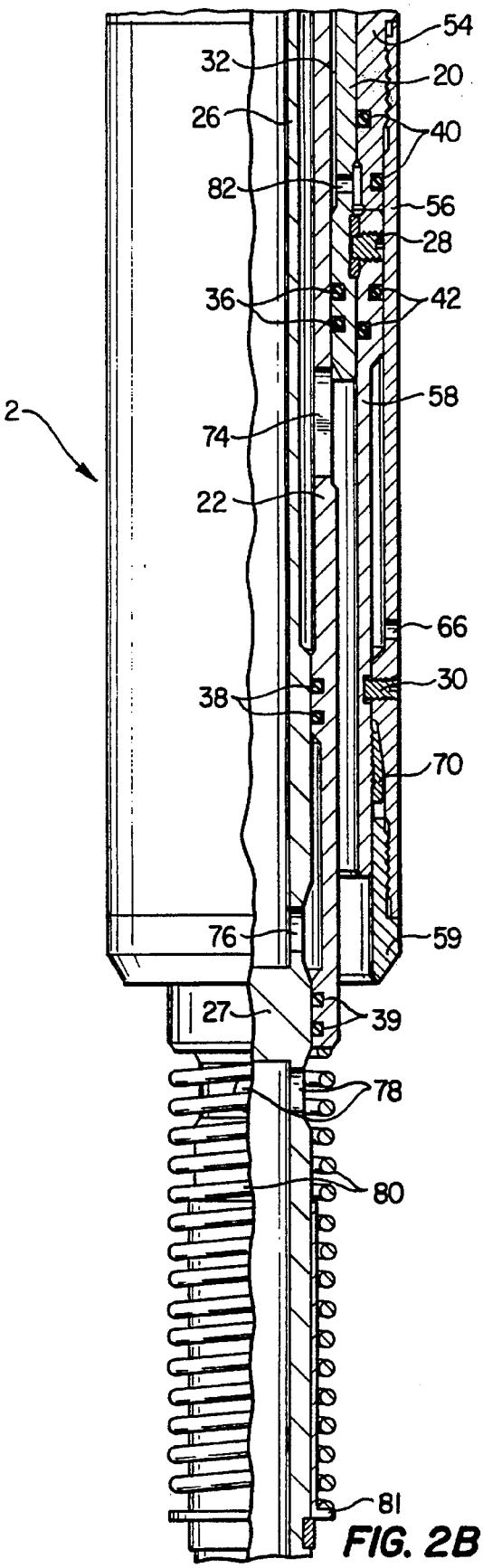

Referring now to FIGS. 2A–2B, a preferred embodiment of the packer safety valve assembly 2 of the present invention is illustrated in part perspective and part cross-sectional view in the run-in position. This is the position of the assembly 2 while the assembly 2 is being run into the wellbore for particular vertical location along the casing 6. The assembly 2 includes a tubing conduit 26 which connects at an upper end with the coil tubing 8*a* (see FIG. 1) and at a lower end with the coil tubing 8*b* (see FIG. 1). The tubing conduit 26 is generally hollow and cylindrical except for a solid portion 27 near the lower end thereof. The solid portion 27 serves to block flow through the hollow portions of the tubing conduit 26. On either side of the solid portion 27, the tubing conduit 26 includes series of radially extending holes, upper tubing ports 76 and lower tubing ports 78. The number of these ports 76, 78 is variable according to desired design. However, a series of four equally spaced ports 76, 78 is preferred for most applications.

Still referring to FIGS. 2A–2B, the tubing conduit 26 is located concentric within a valve piston 22. The valve piston is a hollow, cylindrical piece which abuts the tubing conduit at an upper end at an annular bypass seal 46. The valve piston 22 at a lower end includes one or more lower annular ports 74 which are selectively spaced circumferentially around the valve piston 22. At a lower portion of the valve piston 22 from that of the lower annular ports 74 is located a set of upper piston-tubing seals 38, and lower therefrom a set of lower piston-tubing seals 39. The longitudinal distance along the valve piston 22 between the upper piston-tubing seals 38 and the lower piston-tubing seals 39 is greater than the distance between the upper tubing port 76 and lower tubing port 78 of the tubing conduit 26. As will be more fully discussed hereafter, the valve piston 22 may be selectively shifted so that the upper tubing port 76 and lower tubing port 78 of the tubing conduit 26 are located between the upper piston-tubing seals 38 and lower piston-tubing seals 39 so that fluid may flow within the tubing conduit 26 through the upper tubing port 76 and into the lower tubing port 78 back into the tubing conduit 26 allowing coil tubing 8*a, b* (see FIG. 1) fluid flow through the assembly 2. Note that a spring 80, fixed at one end by a spring retainer 81, pushes the valve piston 22 upwards against the annular bypass seal 46 in the normal position and so closure is maintained through the tubing conduit 26 and no flow is allowed through the coil tubing 8*a, b* unless the valve piston 22 is forced to move downward.

Continuing now to refer to FIGS. 2A–2B, a packer mandrel 20 encloses the valve piston 22 within an annular space formed between the packer mandrel 20 and the tubing conduit 26. The packer mandrel 20 joins with the tubing conduit 26 at an upper end thereof, for example, by threadings along the outer circumference of the tubing conduit 26 and threadings along the inner circumference of the packer mandrel 20. At an upper end of the packer mandrel 20, the packer mandrel 20 is formed with a control conduit 32 which, as will hereafter be more fully described, allows some form of control, in the preferred case, being mechanically activated by pressure, to activate the assembly 2. The packer mandrel 20 at an upper end seals with the tubing conduit 26 by the annular bypass seal 46, which also serves, as previously described, to seal the valve piston 22. Extending downwardly from the location of the annular bypass seal 46, the packer mandrel 20 contains on the inner circumference thereof a set of first piston seals 34. These first piston seals 34 serve to seal the packer mandrel 20 against the valve piston 22. Extending downwardly from the first piston seals 34, the packer mandrel 20 along the outer circumference thereof is fixed with seating for external packer slips 60, and holds an upper packer piston 53, packing 52, and lower packer piston 54. As may be seen in this preferred embodiment, the external packer slips 60 are held in place in the run-in position of the assembly 2 by a slip carrier 62 which is positioned by a retaining pin 64. Also, it may be noted that the upper packer piston 53, packing 52, and lower packer piston 54 are retained in place in the run-in position of the assembly by a first setting pin 24. These external packer slips 60 and the upper packer piston 53, packing 52, and lower packer piston 54 are conventional devices for use in downhole tools where packing is necessary. Although particular slips 60 and the upper packer piston 53, packing 52, and lower packer piston 54 are illustrated in this preferred embodiment, it should be expressly understood that any other devices which accomplish the same objectives in the assembly 2 could alternatively or additionally be used, and all those other devices are included in the invention description herein.

Referring further to FIGS. 2A–2B, the lower packer piston 54 is joined with a piston housing 56, at a lower end of the lower packer piston 54, and an upper end of the piston housing 56, by screw threads. The lower packer piston 54 is also sealed against the packer mandrel 20 and against the piston housing 56 by first packer seals 40 located on the internal concentric surface and external concentric surface of the lower packer piston 54. At a lower end of the packer mandrel 20, the packer mandrel is equipped with certain upper control ports 82 which are spaced concentrically around the packer mandrel 20 and extend from inside to outside thereof. At a further lower portion of the packer mandrel 20, the packer mandrel 20 is equipped with sets of second piston seals 36 which seal the packer mandrel 20 against the valve piston 22 above the lower annular port 74 in this run-in position of the assembly 2. Also in the assembly 2 in the run-in position, the packer mandrel 20 is fixed by a release pin 28 with a release mandrel 58. The release mandrel 58 is cylindrical and of slightly greater inside diameter than the outer diameter of the packer mandrel 20 at the location. The release mandrel 58 is affixed at an upper end below the location of the release pin 28 with inner and outer second packer seals 42 which serve to seal the release mandrel 58 against the packer mandrel 20 and piston housing 56, respectively. At a lower end of the piston housing 56 one or more piston ports 66 are located along the circumference thereof. Further below the piston ports 66, the piston housing 56 is secured with the release mandrel 58 by a second setting pin 30. Below the second setting pin 30 and between the release mandrel 58 and piston housing 56 is enclosed internal packer slips 70 which serve to prevent the piston housing 56 from moving lower in relation to the release mandrel 58. At the lower end of the piston housing 56, a slip cap 59 is secured with the piston housing 56 to maintain the internal packer slips 70 at an appropriate location between the piston housing 56 and release mandrel 58.

Further referring to FIGS. 2A–2B, the assembly 2 is shown within a section of casing 6. As may be seen, the assembly 2 is of somewhat smaller diameter than the internal diameter of the casing 6 when in this run-in position. As will be hereinafter more fully described, activation of the control mechanism of the assembly 2 causes the assembly 2 to become lodged within the casing 6 at an appropriate location. Though not shown in detail in the FIGS. 2A–2B, the tubing conduit 26 of the assembly 2 has appropriate connections at its upper and lower ends for connecting with coil tubing 8*a, b* (see FIG. 1). The assembly 2 may thus be run into the casing 6 within a wellbore along with the coil tubing 8*a, b*. This particular mounting of the assembly 2 on coil tubing 8*a, b* for simple installation and operation of the assembly 2.

Figure 3A:
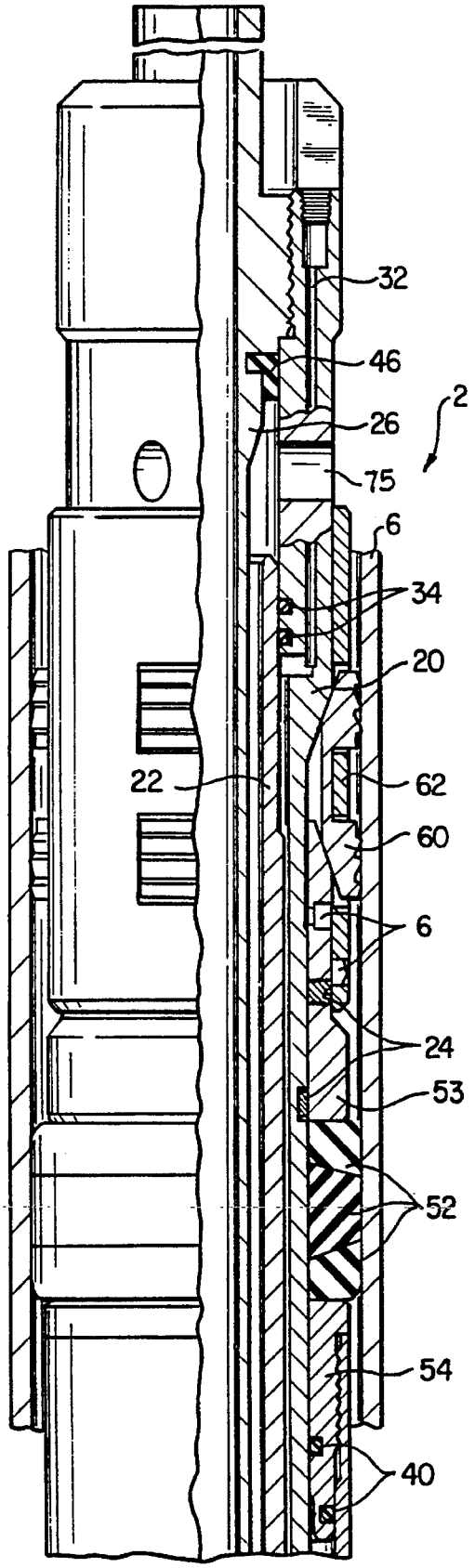
FIGS. 3A–3B are a part perspective and part cross-sectional view through the packer set safety valve of the present invention, showing the assembly in its set position within a casing.
Figure 3B:
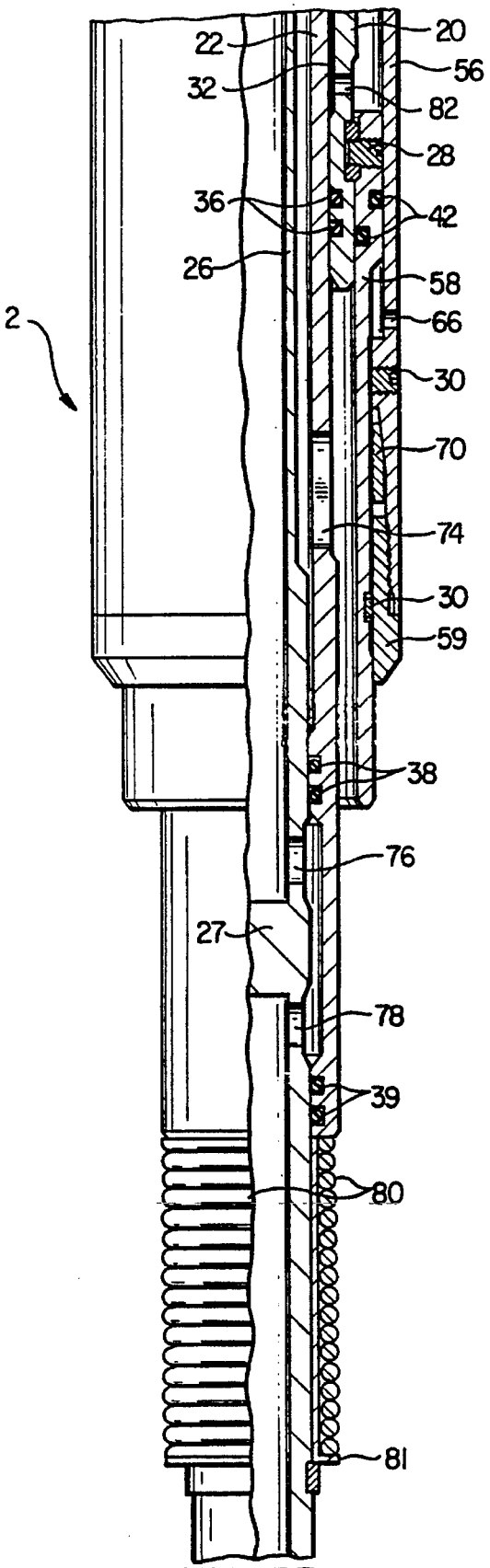

Continuing to refer to FIGS. 2A–2B and now in conjunction with FIGS. 3A–3B, the control conduit 32 and relative relationships of the tubing conduit 26, valve piston 22, and packer mandrel 20 are of particular note. In this preferred embodiment of the assembly 2, the control mechanism for causing the assembly 2 to be set, operated, and released is activated by fluid pressure. Pressured fluid, such as gas in a preferred embodiment, is delivered to the assembly 2 by a control line (not shown) extending from the terranean surface to the assembly 2, through the wellbore. The control line connects with the assembly at the control conduit 32. As may be seen in FIGS. 2A and 3A the control conduit 32 includes internal threading into which the control line may be inserted. The control conduit 32 allows pressurized gas from the surface to be pumped and delivered into the assembly 2. In FIGS. 2A–2B, the control conduit 32 is seen to initially flow within the packer mandrel. The control conduit 32 then opens into a space between the packer mandrel 20 and the valve piston 22, below the first piston seal 34 of the packer mandrel 20. The control conduit 32 then flows in the small annulus between the valve piston 22 and packer mandrel 20 to the upper control port 82 located at the lower end of the packer mandrel 20.

Continuing still to refer to FIGS. 2A–2B and FIGS. 3A–3B in conjunction, as pressure is increased above a certain threshold pressure for the assembly 2 design, the pressure within the control conduit 32 causes the valve piston 22 to be moved downward in relation to the rest of the assembly 2. Further as the pressure is increased beyond a second threshold according to the assembly 2 design, the pressure exerted through the upper control port 82 of the packer mandrel 20 causes the lower packer piston 54, packing 52 and upper packer piston 53 to be jarred in an upward direction shearing the first setting pin 24. After the first setting pin 24 is sheared, a retaining pin joining the upper packer piston 53 and the slip carrier 62 is sheared so that the upper packer piston 53 is caused to move under the external packer slips 60 jamming the external packer slips 60 against the casing 6 and securing the assembly 2 in vertical location along the casing 6. Also, this jamming causes the packing 52 to be squeezed between the lower packer piston 54 and upper packer piston 53 so that the packing 52 is pushed outward to seal the assembly 2 against the casing 6. Although the assembly 2 may be designed to allow for any of a variety of pressures to effect the setting operation, a preferred setting pressure at which the first setting pin 24 is sheared and the assembly 2 becomes set in the casing is 4,000 psi.

Now referring to FIGS. 3A–3B alone, it is seen that the external packer slips 60 fix the assembly 2 in position within the casing 6 and that the packing 52 is squeezed between the upper packer piston 53 and lower packer piston 54 to seal the assembly 2 within the casing 6. In this set position of the assembly 2, the assembly 2 operates to selectively control fluid flows through dual passages of the assembly 2. One of the passages through the assembly 2 is defined by the tubing conduit 26 which connects with coil tubing 8*a, b* (see FIG. 1), although the tubing conduit 26 includes a solid portion 27 which restricts flow through the inside of the tubing conduit 26 thereat. Annular flow in the annular space formed of the casing 6 and coil tubing 8*a, b* flows into the assembly 2 by passing through the upper tubing port 76. When no control pressure is applied through the control conduit 32, the valve piston 22 is positioned in an upward rest against the annular bypass seal 46 (as was shown in FIGS. 2A–2B, but not here). When the valve piston 22 is so positioned (i.e., valve "closed"), flow passing into the tubing conduit 26 is impeded by the solid portion 27, and the valve piston 22 seals the upper tubing port 76 of the valve piston 22. Also when the valve piston 22 is in that closed position, annular fluid flow entering the assembly 2 by the upper tubing port 76 is restricted from further flow through the assembly 2 due to the seal of the valve piston 22 against the packer mandrel 20. Therefore, when no pressure is applied in the control conduit 32, the valve piston 22 maintains the dual flow passageways of the assembly 2 closed and flows of fluids through the assembly 2 are restricted. This preferred embodiment of the assembly is a so-called "fail closed" arrangement because annular and tubing flows are shut-in when no control means acts on the assembly 2. Note that in the preferred embodiment a spring 80, maintained in position by a spring retainer 81, causes the valve piston 22 to be positioned upwards so that fluid flows through the assembly 2 are shut-in.

Still referring to FIGS. 3A–3B, when a sufficient pressure is applied in the control conduit 32, the valve piston 22 is caused to move downward in relation to the rest of the assembly 2 against the force of the spring 80. When the pressure in the control conduit 32 is sufficient to overcome the upward force on the valve piston 22 provided by the spring 80, then the valve piston 22 moves to open the dual passages of the assembly 2 allowing fluid flows through the passages. Annular fluids flow into the assembly 2 via the packer mandrel port 76 and then downward within the assembly 2 annular space between the tubing conduit 26 and valve piston 22. At the lower end of the assembly 2, the annular fluid flows from the assembly 2 annular space between the tubing conduit 26 and valve piston 22 by exiting through the lower annular port 74, into the annular space between the valve piston 22 and release mandrel 58, to outside the assembly 2, and into the annular region below the assembly 2 within the wellbore. The annular fluid then may flow down the wellbore and into the cavern 10 (shown in FIG. 1).

Continuing still to refer to FIGS. 3A–3B, tubing fluid flow passes through the coil tubing 8*a, b* (shown in FIG. 1) into the tubing conduit 26. Because the valve piston 22 is moved downwardly as sufficient pressure is applied through the control conduit 32 to overcome the upward force exerted by the spring 80 force, the valve piston 22 becomes lodged in a manner in which the upper piston-tubing seals 38 and lower piston-tubing seals 39 appear on either side of the upper tubing port 76 and lower tubing port 78 of the tubing conduit 26. In this position, flow into the tubing conduit 26 may exit the tubing conduit 26 through the upper tubing port 76 and flow back into the tubing conduit 26 via the lower tubing port 78, thus bypassing the solid portion 27 of the tubing conduit 26. Tubing flow from downhole within the cavern 10 (see FIG. 1) to the surface (or from the surface to downhole) is therefore possible when the valve piston 22 is so positioned due to application of pressure through the control conduit 32. The particular activating pressure which may operate on the assembly 2 through the control conduit 32 to move the valve piston 22 in this manner may be varied according to design, however, it is preferred that the control conduit 32 pressure necessary to move the valve piston 22, opening flows through the assembly 2, be somewhat lower than the 4,000 psi required to set the assembly and, as will be hereinafter more clearly understood, than the pressure necessary to release the assembly 2. A preferred operational pressure for valve piston 22 movement in the assembly 2 is around 1,000 psi, although other operating pressures may be appropriate in certain applications.

Figure 4A:
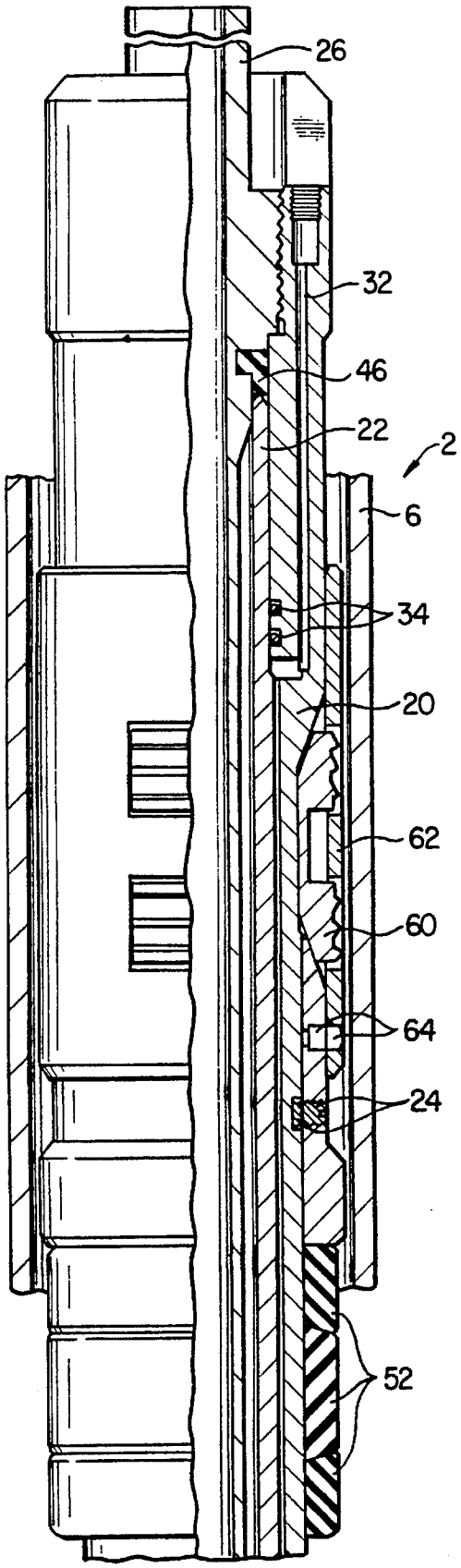
FIGS. 4A–4B are a part perspective and part cross-sectional view through the packer set safety valve of the present invention, showing the assembly in its retrieve position.
Figure 4B:
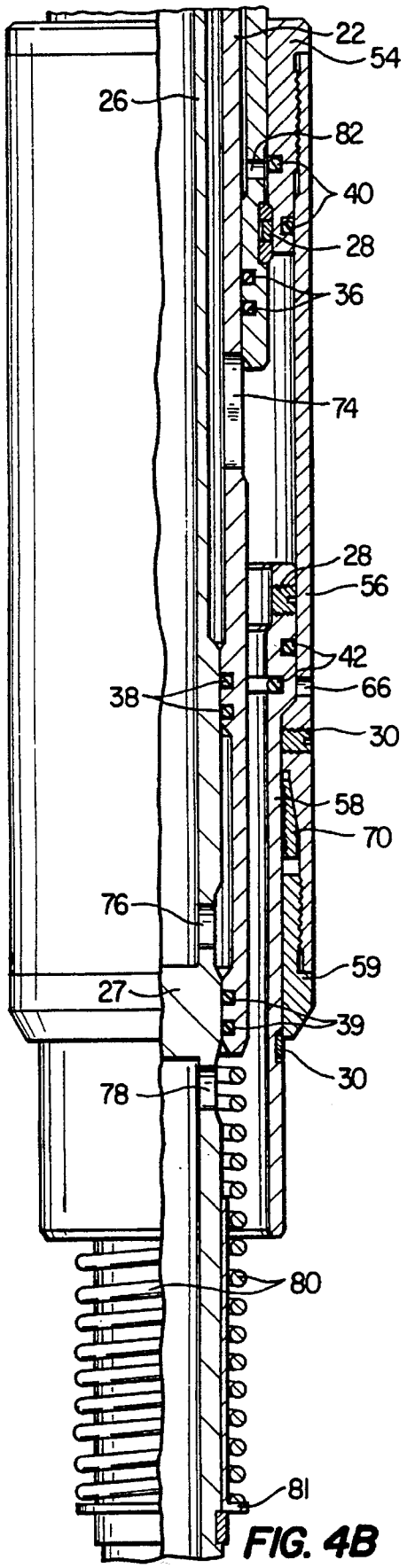

Referring still to FIGS. 3A–3B now in conjunction with FIGS. 4A–4B, release of the assembly 2 from the set position (shown in FIGS. 3A–3B) may be understood. In order to release the assembly 2 from its position of securement within the casing 6, additional pressure is applied through the control conduit 32. The pressure supplied through the control conduit 32 must be sufficient to shear the release pin 28 which secures the packer mandrel 20 to the release mandrel 58 when the assembly 2 is in the set position (see FIGS. 3A–3B). As pressure is increased within the control conduit 32 to exceed the threshold pressure necessary to shear that pin 28, the pressure flows through the control conduit 32 into the annulus formed between the valve piston 22 and the packer mandrel 20, through the upper control port 82 of the packer mandrel 20, into the annular space formed between the packer mandril 20 and the piston housing 56. In the set position, this annular space is contained so that application of pressure exceeding a threshold required to shear release pin 28 will cause movement of the piston housing 56 with respect to the packer mandrel 20. Once the threshold pressure is exceeded, the release mandrel 58, together with the piston housing 56 and lower packer piston 54 affixed thereto, are moved downward with respect to the rest of the assembly 2. This movement releases the squeeze on the packing 52, and the upper packer piston 53 slides from under the external packer slip 60 releasing the assembly from its setting within the casing 6. The assembly 2 may then be retrieved from within the wellbore by pulling the coil tubing 8*a, b* and assembly 2 system. The threshold pressure necessary to shear the release pin 28 should be greater than that required to set the assembly 2, for example, 6,000 psi to release the assembly 2 is preferred in many applications, although other release pressure designs may be appropriate in particular applications and situations.

As will be apparent to those skilled in the art, a variety of variations, substitutions, additions, and other alternatives in design and operation of the packer set safety valve assembly 2, in keeping with the spirit and purposes of the present invention as exemplified by the preferred embodiment, are possible. It is to be understood that the entire variety is included in and forms a part of the invention. There are in addition, however, certain particularly significant alternative embodiments. In one of such alternative embodiments, the assembly 2 is provided with a straight bypass mechanism through which a wireline or other equipment may be inserted to reach from the surface to downhole for downhole operations. This bypass mechanism can be one of the dual flow paths through this assembly 2 or, alternatively, could be a separate path formed through the assembly 2 for such purpose. In another alternative embodiment, the assembly 2 may incorporate other mechanisms and functions which can be controlled in the same manner as the assembly 2 control or by some other activation means. An example is the addition of a flapper valve to the assembly 2 for purposes of providing the above-described bypass mechanism or for other purposes. As those skilled in the art will appreciate, a wide variety of other mechanisms and functions may be incorporated with the assembly 2 for a variety of purposes and applications.

The herein described preferred embodiment of the packer set safety valve assembly 2, and the numerous alternative embodiments and variations thereof, thus, provide for advantages over the prior technology, as previously detailed. In the manufacture of the assembly 2, all parts are preferably formed of materials such as solid, strong steel, iron, composition, or combinations thereof. The parts are also preferably cast and precision machined to provide for maximum strength and appropriate tolerances.

As is clearly seen, the present invention overcomes the problems presented by the prior devices and methods. The present invention is believed to be especially effective when manufactured and employed as described herein, however, those skilled in the art will readily recognize that numerous variations and substitutions may be made in the device and its use and manufacture to achieve substantially the same results as achieved by the embodiments and, in particular, the preferred embodiment expressly described herein. Each of those variations is intended to be included in the description herein and forms a part of the present invention. The foregoing detailed description is, thus, to be clearly understood as being given by way of illustration and example only, the spirit and scope of the present invention being limited solely by the appended claims.

What is claimed is:

1. A packer set safety valve assembly for controlling flows through dual flow paths within a subterranean borehole, comprising:

means for securing said assembly within said borehole, said means for securing being remotely actuatable to allow said assembly to be run into said borehole into select position within said borehole and then secured at said select position within said borehole;

means for selectively allowing and restricting flow passage through said dual flow paths within said borehole, said means for selectively allowing flow passage being remotely actuatable from said assembly within said borehole; and means for unsecuring said assembly from securement within said borehole as and when desired, said means for unsecuring being remotely actuatable to allow said assembly to be unsecured and then said assembly to be retrieved from within said borehole;

wherein said means for securing is self-contained within said safety valve.

2. The assembly of claim 1, wherein said means for selectively allowing and restricting flow passage includes means for preventing flows through said dual flow paths when said means for selectively allowing and restricting flow passage is not actuated to allow flow.

3. The assembly of claim 1, wherein said means for selectively allowing and restricting flow passage prevents flows through said dual flow path if said means is not remotely actuatable.

4. The assembly of claim 3, wherein said means for selectively allowing and restricting includes a piston means, biased in a first direction, said piston means allowing flows through said dual flow paths when sufficient actuating force is applied to said piston means overcoming said bias and moving said piston means in a second direction opposite that of said first direction, said piston means restricting flows through said dual flow paths when said sufficient actuating force is not applied to said piston means.

5. The assembly of claim 4, wherein said dual flow paths are within a coil tubing and in an annular space formed between said coil tubing and said borehole.

6. The assembly of claim 4, wherein said assembly, when restricting fluid flows through said dual flow paths, seals said fluids beneath said assembly's vertical location within said borehole, preventing flows from beneath said assembly's vertical location within said borehole to outside said borehole.

7. The assembly of claim 5, wherein said assembly, when restricting flows through said coil tubing and said annular space, respectively, seals said fluids within said coil tubing and said annular space beneath said assembly's vertical location within said borehole.

8. The assembly of claim 7, wherein said assembly is placed into said borehole for securement within said borehole via said coil tubing and said assembly is retrieved from said borehole when unsecured from within said borehole via said coil tubing.

9. The assembly of claim 7, wherein said assembly includes a tubing conduit through which may selectively pass one of said dual fluids flowing in said coil tubing and an assembly annular space formed between said tubing conduit and said housing of said assembly concentric with said tubing conduit through which may selectively pass the other of said dual fluids flowing in said annular space between said coil tubing and said borehole.

10. The assembly of claim 1, wherein said dual flow paths are within a coil tubing and in an annular space formed between said coil tubing and said borehole.

11. The assembly of claim 1 wherein fluid pressure is employed to activate said means for securing to secure said assembly within said borehole, to actuate said means for selectively allowing and restricting flow passage to control said flow through said dual flow paths, and to activate said means for unsecuring to unsecure said assembly from within said borehole.

12. The assembly of claim 11, wherein said fluid pressure to activate said means for securing is at least about 2,000 psi, said fluid pressure to actuate said means for selectively allowing and restricting flow passage is lower than about 6,000 psi, and said fluid pressure to activate said means for unsecuring is at least about 6,500 psi.

13. A packer set safety valve for controlling flows of dual fluids, one of said dual fluids flowing in a tubing string of a subterranean well, the other of said fluids flowing in an annular space formed between said tubing string and a wellbore of said subterranean well, comprising:

means for opening said safety valve to allow flows of said fluids between said wellbore and outside said wellbore;

means for selectively actuating said means for opening to allow said flows; and means, self-contained within said safety valve for selectively securing said safety valve within said wellbore for operation.

14. The safety valve of claim 13, wherein said safety valve is closed unless said means for selectively actuating activates said means for opening to allow flows of said fluids between said wellbore and outside said wellbore.

15. The safety valve of claim 14, wherein said dual flows are in opposite directions.

16. The safety valve of claim 15, wherein said subterranean well is a gas storage well.

17. The safety valve of claim 16, wherein said means for opening includes a tubing conduit having a solid portion therein and an upper tubing port and a lower tubing port situated on either side of said tubing conduit, said tubing conduit connects with said tubing string, and a valve piston, concentric with and slidably engaged with said tubing conduit, said valve piston acting to open said upper tubing port and said lower tubing port to allow flow therebetween and through said tubing conduit of said fluid flowing in said tubing string when said means for selectively actuating is actuated and maintaining said upper tubing port and said lower tubing port closed preventing flow therebetween and through s aid tubing conduit when said means for selectively actuating is not actuated.

18. The safety valve of claim 17, wherein said means for opening includes a packer mandrel enclosing said tubing conduit and said valve piston and having an upper tubing port closed by said valve piston to fluid flow therethrough but open for fluid flow therethrough when said means for selectively actuating is activated and said valve piston includes a lower annular port allowing fluid flow from within an annulus between said tubing conduit and said valve piston when said means for selectively actuating is actuated but preventing said fluid flow when said means for selectively actuating is not actuated, said flow being said fluid flowing in said annular space formed between said tubing string and a wellbore of said subterranean well.

19. The safety valve of claim 18, further comprising means for setting said safety valve in select location within said wellbore, means for sealing said safety valve within said wellbore at said select location, means for unsecuring said safety valve from said select location within said wellbore, and means for unsealing said safety valve from within said wellbore at said select location and wherein said means for setting, said means for sealing, said means for unsecuring, and said means for unsealing are each activated by pressurized control fluid.

20. The safety valve of claim 18, wherein said means for opening includes a packer mandrel enclosing said tubing conduit and said valve piston and having an upper tubing port closed by said valve piston to fluid flow therethrough but open for fluid flow therethrough when said means for selectively actuating is activated and said valve piston includes a lower annular port allowing fluid flow from within an annulus between said tubing conduit and said valve piston when said means for selectively actuating is actuated but preventing said fluid flow when said means for selectively actuating is not actuated, said flow being said fluid flowing in said annular space formed between said tubing string and a wellbore of said subterranean well.

21. The safety valve of claim 20, further comprising means for setting said safety valve in select location within said wellbore, means for sealing said safety valve within said wellbore at said select location, means for unsecuring said safety valve from said select location within said wellbore, and means for unsealing said safety valve from within said wellbore at said select location and wherein said means for setting, said means for sealing, said means for unsecuring, and said means for unsealing are each activated by pressurized control fluid.

22. The safety valve of clam 13, further comprising means for setting said safety valve in select location within said wellbore and means for unsecuring said safety valve from said select location within said wellbore and wherein each of said means for selectively actuating, said means for setting, and said means for unsecuring are actuated by pressure.

23. A method of controlling dual flows within segregated spaces of a longitudinally extending chamber, comprising the step of placing a packer set safety valve assembly across each of said segregated spaces parallel to a primary direction of said flows, wherein said step of placing is solely dependent on characteristics of said safety valve, independent of characteristics of said chamber and said step of placing requires securement of only said safety valve with said chamber.

24. A method of controlling fluid flow in a wellbore containing a tubing string in which a first fluid flows and an annular space between said tubing string and a concentric inner surface of said wellbore in which a second fluid flows, comprising the steps of:

placing an assembly for controlling flows within said tubing string and within said annular space in said wellbore, said assembly including:

(a) means for securing said assembly within said wellbore, said means for securing being remotely actuatable, and (b) means for selectively allowing and restricting flow passage through said tubing string and through said annular space, said means for securing being remotely actuatable; and actuating said means for securing to set said assembly at a select location in said wellbore; and actuating said means for selectively allowing and restricting flow to selectively allow and selectively restrict flow passage through said tubing string and through said annular space;

wherein said assembly is self-contained to allow said assembly to be secured within said wellbore at any location.

25. The method of claim 24, wherein said assembly further includes means for unsecuring said assembly from securement within said wellbore, said means for unsecuring being remotely actuatable, and further comprising the step of actuating said means for unsecuring to unsecure said assembly from within said wellbore for retrieval of said assembly.

26. A packer set safety valve assembly for controlling flows through dual flow paths within a subterranean borehole, comprising:

means for securing said assembly within said borehole, said means for securing being remotely actuatable to allow said assembly to be run into said borehole into select position within said borehole and then secured at said select position within said borehole;

means for selectively allowing and restricting flow passage through said dual flow paths within said borehole, said means for selectively allowing flow passage being remotely actuatable from said assembly within said borehole;

means for unsecuring said assembly from securement within said borehole as and when desired, said means for unsecuring being remotely actuatable to allow said assembly to be unsecured and then said assembly to be retrieved from within said borehole;

wherein fluid pressure is employed to activate said means for securing to secure said assembly within said borehole, to actuate said means for selectively allowing and restricting flow passage to control said flow through said dual flow paths, and to activate said means for unsecuring to unsecure said assembly from within said borehole; and wherein said fluid pressure to activate said means for securing is at least about 2,000 psi, said fluid pressure to actuate said means for selectively allowing and restricting flow passage is lower than about 6,000 psi, and said fluid pressure to activate said means for unsecuring is at least about 6,500 psi.

27. A packer set safety valve for controlling flows of dual fluids, one of said dual fluids flowing in a tubing string of a subterranean well, the other of said fluids flowing in an annular space formed between said tubing string and a wellbore of said subterranean well, comprising:

means for opening said safety valve to allow flows of said fluids between said wellbore and outside said wellbore; and means for selectively actuating said means for opening to allow said flows;

wherein said safety valve is closed unless said means for selectively actuating activates said means for opening to allow flows of said fluids between said wellbore and outside said wellbore;

wherein said dual flows are in opposite directions;

wherein said subterranean well is a gas storage well; and wherein said means for opening includes a tubing conduit having a solid portion therein and an upper tubing port and a lower tubing port situated on either side of said tubing conduit, said tubing conduit connects with said tubing string, and a valve piston, concentric with and slidably engaged with said tubing conduit, said valve piston acting to open said upper tubing port and said lower tubing port to allow flow therebetween and through said tubing conduit of said fluid flowing in said tubing string when said means for selectively actuating is actuated and maintaining said upper robing port and said lower tubing port closed preventing flow therebetween and through said tubing conduit when said means for selectively actuating is not actuated.

* * * * *

UNITED STATES PATENT AND TRADEMARK OFFICE

CERTIFICATE OF CORRECTION

PATENT NO. : 5,505,263

DATED : Apr. 9, 1996

INVENTOR(S) : White et al.

It is certified that error appears in the above-indentified patent and that said Letters Patent is hereby corrected as shown below:

Title Page Add --[73] Assignee: Halliburton Company, Dallas, Tex.--

Signed and Sealed this

Eleventh Day of February, 1997

*Attest:*

*Attesting Officer*

BRUCE LEHMAN

*Commissioner of Patents and Trademarks*